US006157666A

United States Patent [19]

Della Vedova et al.

[11] Patent Number: 6,157,666

[45] Date of Patent: Dec. 5, 2000

[54] CONTROLLED CURRENT FEED DEVICE FOR ELECTRIC ARC FURNACE

[75] Inventors: Ferruccio Della Vedova, Zugliano-Pozzuolo del Friuli; Gianni Gensini, Buia; Riccardo Fragiacomo, Mestre, all of Italy

[73] Assignee: Centro Automation SpA, Buttrio, Italy

[21] Appl. No.: 09/359,761

[22] Filed: Jul. 22, 1999

[30] Foreign Application Priority Data

Jul. 24, 1998 [IT] Italy ..... UD98A0133

[51] Int. Cl.[7] ..... H05B 7/11

[52] U.S. Cl. ..... 373/103; 373/48; 373/102

[58] Field of Search ..... 373/47–49, 70, 373/102, 103, 104

[56] References Cited

U.S. PATENT DOCUMENTS

| | | | |
|---|---|---|---|
| 3,567,837 | 3/1971 | Van Nostran | 373/104 |
| 3,952,138 | 4/1976 | Nanjyo et al. | 373/104 |
| 5,239,554 | 8/1993 | Gensini et al. | 373/102 |

OTHER PUBLICATIONS

L.C. Elliott: "Electric Power Systems for Large Arc Furnaces" Westinghouse Engineer, vol. 29, Dec. 1969, pp. 143–149.

Yngve Sundberg "The Arc Furnace As A Load On The Network" ASEA Journal vol. 49, 1976 pp. 75–87.

Richard F. Dudley: "Special Design Considerations For Filter Banks in Arc Furnace Installations" IEEE Transactions On Industry vol. 33, No. 1, Jan. 1997.

*Primary Examiner*—Tu Ba Hoang

*Attorney, Agent, or Firm*—Antonelli, Terry, Stout & Kraus, LLP

[57] ABSTRACT

Controlled current feed device for electric arc furnace employed to melt metals, wherein the feed line comprises at least a medium tension bar (13), a feed control device and a transformer (17) serving the furnace, the feed control device (16) being arranged between the medium tension bar (13) and the transformer of the furnace (17) and comprising a mutual inductor (19) consisting of a primary coil **(19*a*) and a secondary (19*b*) coil, the primary coil (19*a*) being arranged in serial connection on the feed line (10) and the secondary coil (19*b*) being connected to at least a re-phasing filter (20) comprising at least a condenser (22)**.

5 Claims, 1 Drawing Sheet

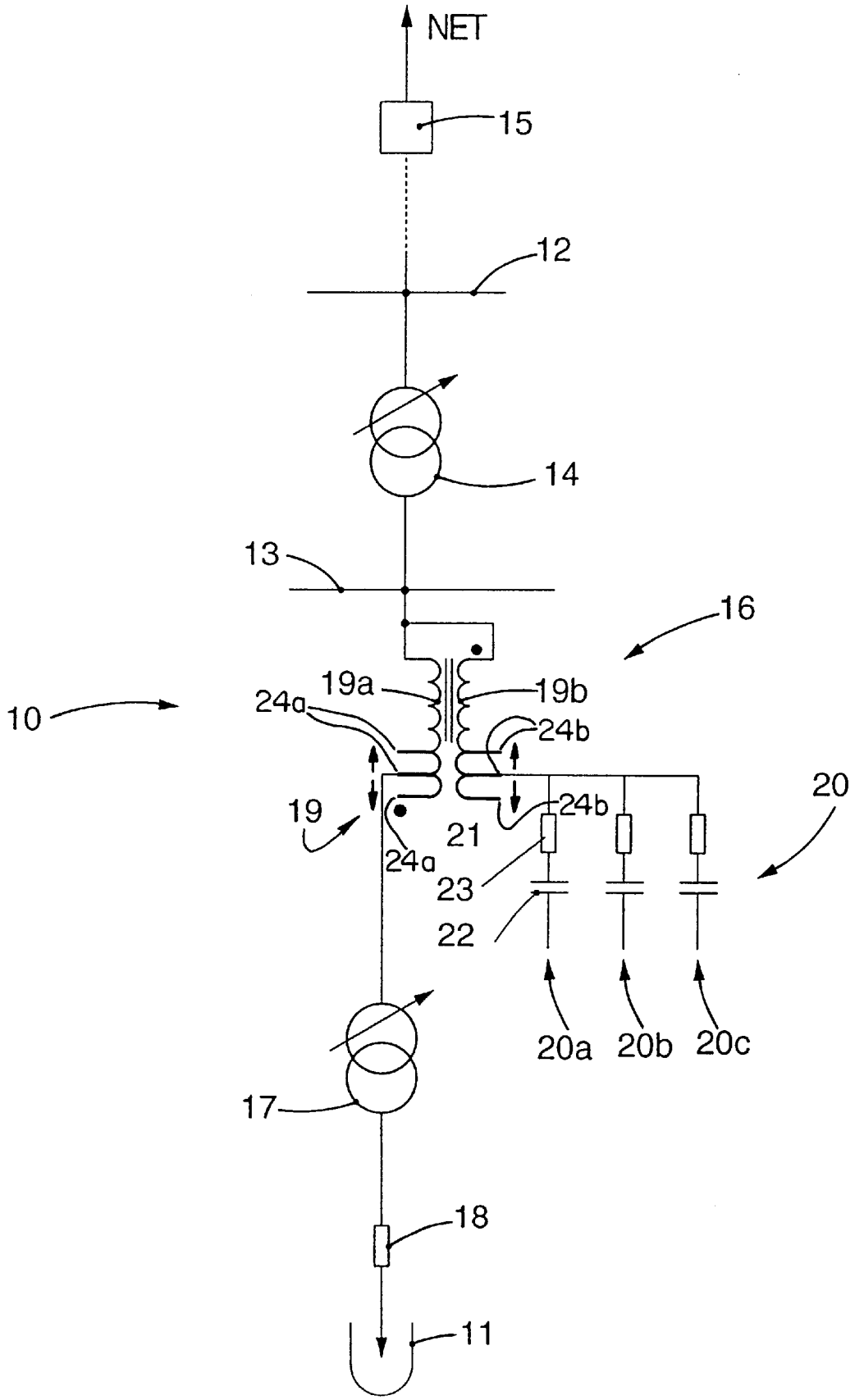
NET
15
12
14
13
16
10
19a
19b
24a
24b
19
21
24b
24a
23
22
20
20a
20b
20c
17
18
11

CONTROLLED CURRENT FEED DEVICE FOR ELECTRIC ARC FURNACE

FIELD OF THE INVENTION

This invention concerns a controlled current feed device for electric arc furnaces.

The invention is applied in the field of electric melting furnaces to produce steel or alloys thereof, in order to guarantee minimum disturbances on the mains supply (flicker) caused by peaks of load absorption and phase displacements on the line due to the strongly inductive characteristics of the loads to be supplied.

BACKGROUND OF THE INVENTION

In recent years there has been a considerable increase in the power supplied to electric arc furnaces employed for melting metals, passing from unitary powers of 16 MW and 20 MVA to powers of more than 85 MW and over 120 MVA.

These high powers create serious problems of disturbance in the tension (flicker) for the mains supply, and also considerable phase displacements due to the inductive characteristics of the loads.

There are various techniques known to the state of the art which are used to reduce such tension fluctuations and/or to re-phase the inductive loads.

Some examples of these techniques are shown in the article by L. C. Elliott "Electric Power Systems for large Arc Furnaces", WESTINGHOUSE ENGINEER, vol. 29, December 1969, pages 143–149, in the article by Yngve Sundberg "The arc furnace as a load in the network", ASEA journal, vol. 49, 1976, pages 75–87, in the article by Richard F. Dudley "Special Design Considerations . . . ", IEEE TRANSACTIONS ON INDUSTRY APPLICATIONS, vol. 33, no. 1, January 1997–February 1997 and in the patent U.S. Pat. No. 3,567,837.

A first technique is to place a stationary inductor on each branch of the feed line of the furnace, with the function of limiting the maximum current absorbed by the furnace.

This solution has the advantage of being simple and economical, but has great limits because it cannot be regulated and cannot therefore be adapted to the variable conditions which occur during the melting cycle.

In co-operation with these stationary inductors, there are re-phasing filters on the medium tension bar which generally consist of a condenser and an inductor in serial connection; these have the function of re-phasing and filtering the harmonics introduced onto the line by the furnace and by the feed control system.

Another solution provides to arrange on the feed line, parallel to the re-phasing filters, a system of inductors which can be inserted by means of thyristors.

When the inductive-type power required by the furnace varies, the thyristors insert the system of inductors into, or remove said system from, the line, so as to compensate this variation.

This adjustment system balances the inductive component, and maintains at a low value the total reactive power employed by the furnace, the reactors and the series of re-phasing filters.

This solution has a certain flexibility and versatility, but it also has the disadvantage that it is very expensive and complex to manage, and that it introduces harmonics into the line.

Moreover, the active power of the arcs of the furnace is adjusted only by varying the height of the electrodes by means of appropriate hydraulic units, trying to maintain the resistances of the arcs themselves constant. This entails long response times and limited accuracy due to the mechanical sizes being acted on.

Another technique is to act directly on the current of the arc of the furnace so as to determine the working point and reduce the disturbances.

With this technique, a saturable reactor is arranged in serial connection on the feed line of the furnace which, when excited by an appropriate continuous current, has the characteristic that it has a low reactance value for small values of current required by the furnace and a high value of reactance for high values of current.

Therefore, once the working point has been set by choosing the polarisation current, the saturable reactor automatically limits the overcurrents, with a consequent reduction of flicker on the mains supply.

This solution has the advantage that it does not need a complicated control system and is potentially valid in that it acts directly on the electric sizes feeding the furnace, limiting drops in tension caused by the unstable functioning of the arcs of the furnace.

However, the inclusion of saturable or dividable inductors on the feed line introduces a further lack of linearity into the system in addition to that caused by the furnace itself, and therefore causes a high number of harmonics to be generated and introduced into the line, with the consequent negative effects.

Moreover, these systems are expensive and burdensome to install and manage.

The present applicant has devised, tested and embodied this invention to overcome all these shortcomings with a simple but at the same time very efficient solution.

SUMMARY OF THE INVENTION

The purpose of the invention is to provide a controlled current feed device for an electric arc furnace with the following characteristics:

- maximum efficiency in reducing flickering on the mains supply due to instantaneous drops in tension caused by the absorption peaks of the furnace;
- substantially zero response times;
- lower costs than the solutions described above (controlled inductors with thyristors and saturable reactor) and not much more than the solution with a single stationary reactor located in serial connection on the feed line;
- it exerts an automatic re-phasing action of the load with respect to the feed line;
- it does not generate its own harmonics in the system since there are no non-linear components; therefore it is not necessary to provide additional filters besides those required by the furnace;
- it can be installed almost universally on any pre-existing plant;
- reduced size with the same effect and ease of installation and management as solutions with, for example, a saturable reactor;
- requires fewer manoeuvres of the tap-changer compared with solutions with stationary or divided reactor.

The invention provides to locate on the feed line of the furnace a mutual inductor, whose secondary coil is connected with at least a re-phasing filter comprising at least a condenser.

In the preferential embodiment of the invention there are two or three re-phasing filters arranged in parallel.

In a preferential but non-restrictive embodiment, each re-phasing filter comprises a condenser and an inductor in serial connection.

According to a variant, the mutual inductor is of the type with an air gap.

The mutual inductor has two functions.

A first function is obtained due to the fact that the primary coil, due to the effect of the air gap and the consequent dispersion inductance, performs the known function of fixed reactance in serial connection with the furnace.

A second function is obtained due to the fact that, as the current required by the furnace varies, the mutual inductor acts on the re-phasing filters and gives rise to a variation of equal sign of the reactive capacitive power.

In other words, if the current required by the furnace increases, due to the effect of the mutual inductor the tension on the condensers also increases in a correlated manner, and consequently the capacitive component of the reactive power transmitted on the line also increases.

In this way there is an automatic compensation, caused by the capacitive component, of the induction-type reactive power required by the furnace.

The percentage of compensation can be adjusted by acting on the size of the mutual inductor and/or the re-phasing filters.

In this way the invention ensures an automatic and immediate adjustment, with a circuit which is linear and which therefore does not introduce its own harmonics, and which furthermore exerts an automatic re-phasing function on the reactive power, compensating the variations in the inductive component in the power with correlated variations in the capacitive component.

BRIEF DESCRIPTION OF THE DRAWING

The attached FIGURE is given as a non-restrictive example and shows a preferential embodiment of the controlled current feed device for electric arc furnace according to the invention.

DETAILED DESCRIPTION OF THE PREFERRED EMBODIMENT

The sole FIGURE shows, in a simplified form, a diagram of the feed line, indicated generally by the reference number 10, of a three-phase electric furnace 11.

The FIGURE represents one of the branches of the three-phase furnace 11, but it is understood that this representation is valid for each of the three branches of the furnace 11.

The reference number 12 indicates the high tension bar which is connected to the medium tension bar 13 through a mains transformer 14.

Reference number 15 denotes the equivalent network impedance.

The medium tension bar 13 is connected to the furnace 11 through the device 16 according to the invention, which is located upstream of the furnace transformer 17. Number 18 denotes the equivalent inductive-type impedance of the furnace 11.

The device 16 consists of a mutual inductor 19 whose primary coil 19*a* is located directly in serial connection on the feed line of the furnace 11 and whose secondary coil 19*b* is connected to a series of re-phasing filters 20, respectively 20*a*, 20*b* and 20*c*, which are arranged parallel and each of which comprises at least a condenser 22.

In the embodiment shown here, there are three re-phasing filters 20, but it remains within the scope of the invention if one, two, four or more re-phasing filters 20 are provided.

Moreover, in the embodiment shown here, the re-phasing filters 20 consist of the condenser 22 and a relative inductor in serial connection 23, but it remains within the scope of the invention if other components associated with the condenser 22 are provided.

In the preferential embodiment of the invention, the core 21 of the mutual inductor 19 is of the type with an air gap.

With the device 16 according to the invention, every fluctuation in the current on the feed line of the furnace 11 produces a concomitant variation of the same sign as the capacitive component of the reactive power, due to the automatic variation in the tension applied to the re-phasing filters 20*a*, 20*b* and 20*c*, and in particular to the respective condensers 22.

This derives from the fact that the current flowing in the secondary 19*b* and the current flowing in the primary 19*a* are of opposite signs, as indicated by the symbols in the FIGURE.

Therefore, there is an automatic increase in the re-phasing of the load without any harmonics being introduced, wherein every increase in the inductive component of the reactive power required by the furnace 11 is automatically compensated by a correlated increase in the capacitive component due to the re-phasing filters 20*a*, 20*b* and 20*c*.

Due to the air gap in the core 21, the primary coil 19*a* of the mutual inductor 19 also performs the function of a serial reactor located on the feed line 10 of the furnace 11 because of the dispersion inductance.

In a variant, the mutual inductor 19 is of the type with connectors of sockets 24*a*, 24*b* applied to the primary coil 19*a* and/or the secondary coil 19*b*, which can be selected as an alternative. In this way, by adjusting the working parameters it is possible to make the device 16 more flexible and better able to adapt to those anomalous situations which occur in electric furnaces in a melting cycle.

It should also be noted that the action of the mutual inductor 19 is specific and autonomous for each of the three arcs, which guarantees a balance in the feed to the three branches of the three-phase circuit even in the event of an asymmetrical behaviour of the furnace; it therefore also ensures regular and uniform functioning with respect to the feed line.

What is claimed is:

1. A controlled current feed device for an electric arc furnace employed to melt metals, comprising a feed line which comprises at least a medium tension bar, a feed control device and a transformer serving the furnace, characterized in that the feed control device is arranged between the medium tension bar and the transformer of the furnace and comprises a mutual inductor having a primary coil and a secondary coil, the primary coil being arranged in serial connection on the feed line and the secondary coil being connected to at least a re-phasing filter comprising at least a condenser.

2. The controlled current feed device as in claim 1, characterized in that the secondary coil of the mutual inductor is connected to two or three re-phasing filters arranged parallel to each other.

3. The controlled current feed device as in claim 2, characterized in that each re-phasing filter comprises an inductor arranged in serial connection with the relative condenser.

4. The controlled current feed device as in claim 1, characterized in that a core of the mutual inductor is of the type with an air gap and the primary coil performs a function fo a stationary reactor in serial connection on the feed line.

5. The controlled current feed device as in claim 1, characterized in that the mutual inductor is associated with a plurality of sockets with are selected as alternatives and have a function of adjusting working parameters of the control device.

* * * * *